US008714993B2

(12) United States Patent
Liang et al.

(10) Patent No.: US 8,714,993 B2
(45) Date of Patent: May 6, 2014

(54) BUTTON STRUCTURE AND KEYBOARD STRUCTURE USING THE SAME

(75) Inventors: Chen-Yi Liang, New Taipei (TW); Cheng-Hsiang Chuang, New Taipei (TW)

(73) Assignee: Wistron Corporation, New Taipei (TW)

( * ) Notice: Subject to any disclaimer, the term of this patent is extended or adjusted under 35 U.S.C. 154(b) by 148 days.

(21) Appl. No.: 13/438,919

(22) Filed: Apr. 4, 2012

(65) Prior Publication Data

US 2013/0134022 A1 May 30, 2013

(30) Foreign Application Priority Data

Nov. 30, 2011 (TW) ..... 100144045 A

(51) Int. Cl.
*H01H 13/70* (2006.01)

(52) U.S. Cl.
USPC ..... 439/344

(58) Field of Classification Search
USPC ..... 200/344, 5 A, 512–520, 523, 310–314, 200/317, 343, 276, 242, 245, 253; 400/491.1, 491, 495, 496, 495.1
See application file for complete search history.

(56) References Cited

U.S. PATENT DOCUMENTS

| | | | | |
|---|---|---|---|---|
| 4,349,286 | A | 9/1982 | Blaser et al. | |
| 4,729,679 | A | 3/1988 | Hou | |
| 6,268,578 | B1 * | 7/2001 | Nakai | 200/520 |
| 6,733,196 | B2 | 5/2004 | Lee et al. | |
| 2010/0231423 | A1 * | 9/2010 | Yang | 341/32 |
| 2010/0243419 | A1 * | 9/2010 | Lee | 200/344 |

OTHER PUBLICATIONS

TW Office Action dated Dec. 11, 2013.

* cited by examiner

*Primary Examiner* — Renee S Luebke
*Assistant Examiner* — Harshad Patel
(74) *Attorney, Agent, or Firm* — McClure, Qualey & Rodack, LLP

(57) ABSTRACT

A button structure includes a key cap, a first supporting member, a second supporting member, an elastomer and a base plate. The first supporting member has a first bending portion and a second bending portion. The second supporting member is cross-connected with the first supporting member. The second supporting member has a third bending portion and a fourth bending portion. The third bending portion passes through the first bending portion and abuts an inside of the first bending portion. The second bending portion passes through the fourth bending portion and abuts an inside of the fourth bending portion. The elastomer below the key cap supports the key cap. The base plate is for supporting the first supporting member, the second supporting member and the elastomer. The key cap is able to move up and down through operations of the first supporting member, the second supporting member and the elastomer.

16 Claims, 5 Drawing Sheets

BUTTON STRUCTURE AND KEYBOARD STRUCTURE USING THE SAME

This application claims the benefit of Taiwan application Serial No. 100144045, filed Nov. 30, 2011, the subject matter of which is incorporated herein by reference.

BACKGROUND OF THE INVENTION

1. Field of the Invention

The invention relates in general to an input device, and more particularly to a button structure and a keyboard structure using the button structure.

2. Description of the Related Art

Applications of input devices prevail along with research and development of input devices. A most common input device is, e.g., a keyboard, a touch panel or a mouse. Taking a keyboard for example, a keyboard includes several button structures corresponding to different characters or symbols. When the buttons are pressed by a user, signals of the corresponding characters or symbols are then inputted to an electronic device. A current keyboard button generally includes a key cap, a scissor structure and a base plate. The scissor structure is disposed between the base plate and the key cap to support the cap key and allow the key cap to vertically move relative to the base plate. A conventional scissor structure is a plastic material that is first formed by a mold opening process, followed by manually assembling two stands of the scissor structure to allow the two stands to be pivotally connected and slide against each other. However, the convention scissor structure suffers from several drawbacks. First of all, the convention scissor structure has a high mold cost and its assembly process is quite timing consuming. Also, the two stands of the convention scissor structure are pivotally connected via a short axis that easily breaks during the assembly process. Further, the plastic material offers inadequate strength and is necessarily increased in thickness in order to provide reinforced strength. The increased thickness undesirably affects an overall height of the button structure and thus fails to meet requirements for a compact design.

Therefore, there is a need for a solution that overcomes structural and assembly issues of a conventional button structure.

SUMMARY OF THE INVENTION

The invention is directed to a button structure and a keyboard structure using the button structure for overcoming structural and assembly issues of a conventional button structure.

According to an aspect of the present invention, a button structure is provided. The button structure includes a key cap, a first supporting member, a second supporting member, an elastomer and a base plate. The first supporting member connects to a bottom of the key cap. The first supporting member has a first bending portion and a second bending portion. The second supporting member connects to the bottom of the key cap and cross-connects with the first supporting member. The second supporting member has a third bending portion and a fourth bending portion. The third bending portion passes through the first bending portion and abuts an inside of the first bending portion. The second bending portion passes through the fourth bending portion and abuts an inside of the fourth bending portion. The elastomer is located below the key cap and supports the key cap. The base plate is for supporting the first supporting member, the second supporting member and the elastomer. The key cap is able to move up and down through operations of the first supporting member, the second supporting member and the elastomer.

According to another aspect of the present invention, a keyboard structure is provided. The keyboard structure includes a flexible printed circuit board and a plurality of button structures. The button structures are for touching the flexible printed circuit board. Each of the button structures includes a key cap, a first supporting member, a second supporting member, an elastomer and a base plate. The first supporting member connects to a bottom of the key cap. The first supporting member has a first bending portion and a second bending portion. The second supporting member connects to the bottom of the key cap and cross-connects with the first supporting member. The second supporting member has a third bending portion and a fourth bending portion. The third bending portion passes through the first bending portion and abuts an inside of the first bending portion. The second bending portion passes through the fourth bending portion and abuts an inside of the fourth bending portion. The elastomer is located below the key cap and supports the key cap. The base plate is for supporting the first supporting member, the second supporting member and the elastomer. The key cap is able to move up and down through operations of the first supporting member, the second supporting member and the elastomer.

The above and other aspects of the invention will become better understood with regard to the following detailed description of the preferred but non-limiting embodiment(s). The following description is made with reference to the accompanying drawings.

DETAILED DESCRIPTION OF THE INVENTION

According to an embodiment of a button structure and a keyboard structure using the button structure, a first supporting member and a second supporting member are manufactured from a metal (or a bendable and flexible material). The first and second supporting members abut each other through respective bending portions, and are capable of cross-connected movements. Accordingly, when a key cap is moved up and down, the first and second supporting members steadily support a bottom of a key cap such that the key cap is not horizontally wavered or bears uneven stress.

Various embodiments shall be described below to better understand details and spirit of the present invention. It should be noted that the embodiments are for illustrating the present invention rather than limiting the present invention therein.

Figure 1A:
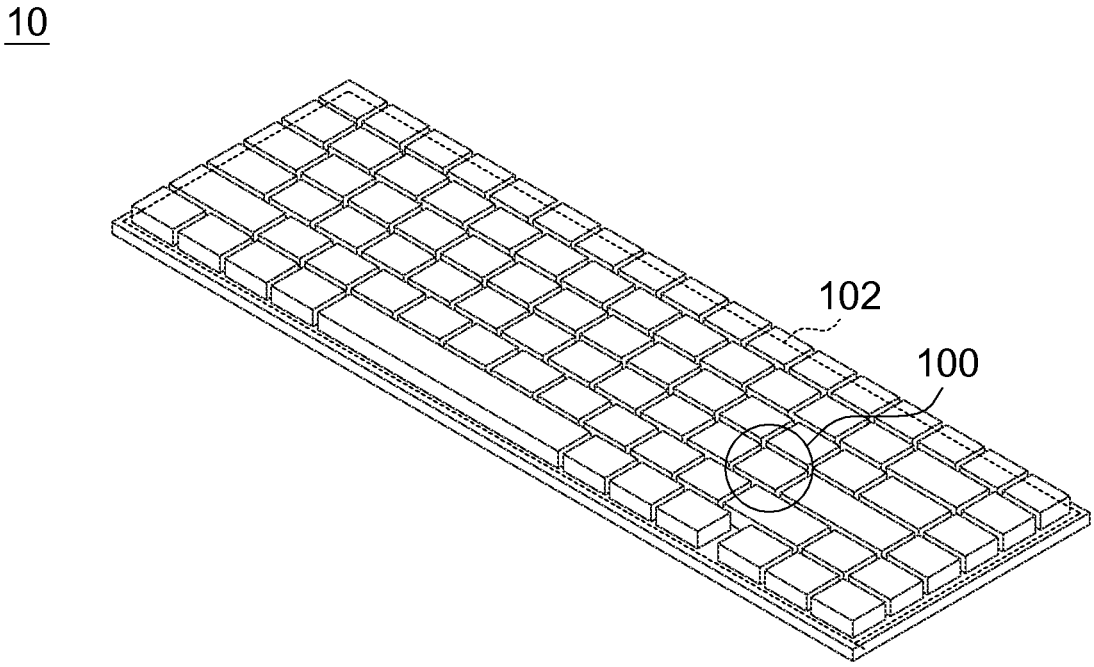
FIG. 1A is a diagram of a keyboard structure according to an embodiment of the present invention.
Figure 1B:
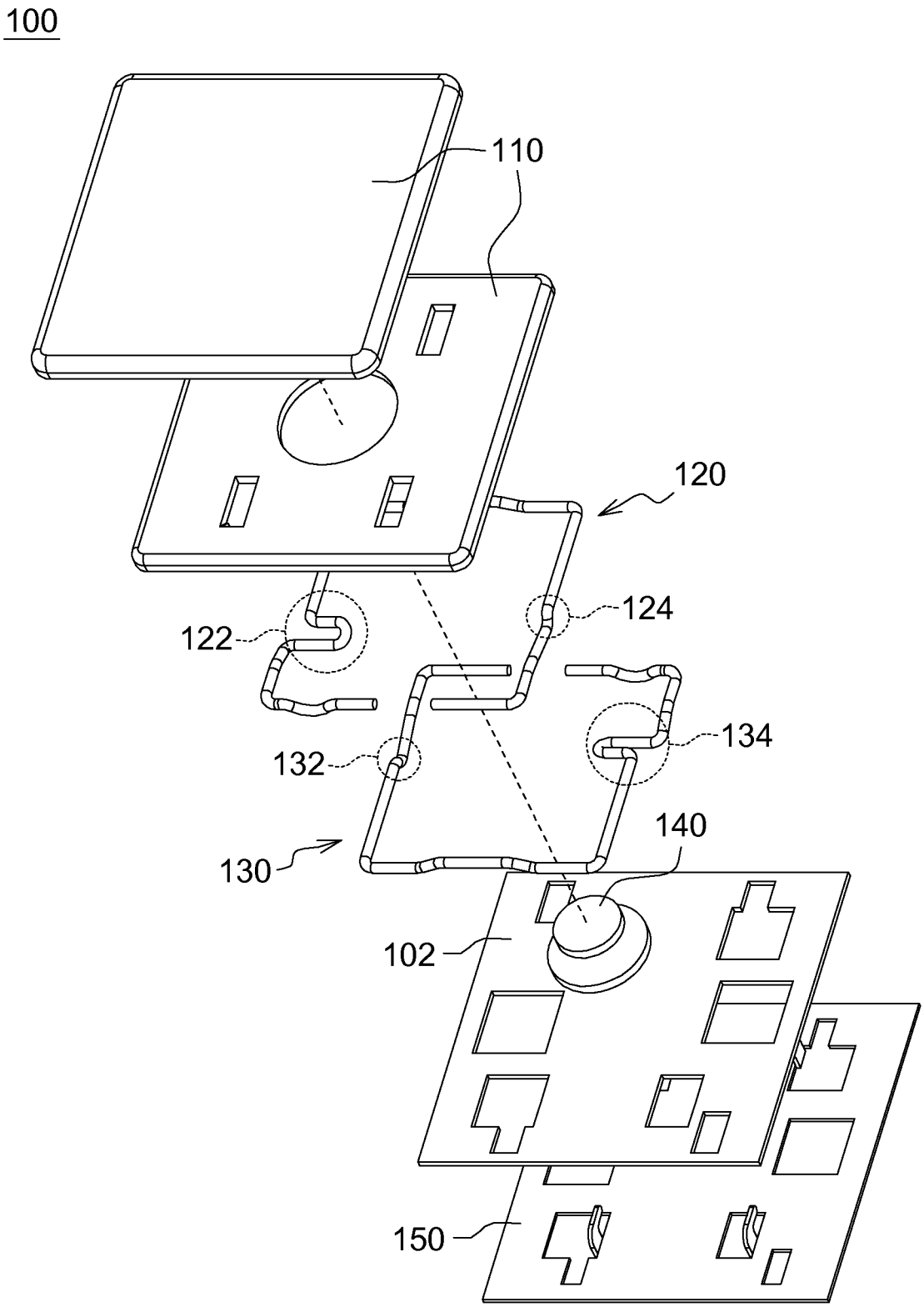
FIG. 1B is an exploded view of a button structure implemented to the keyboard structure in FIG. 1A.
Figure 2:
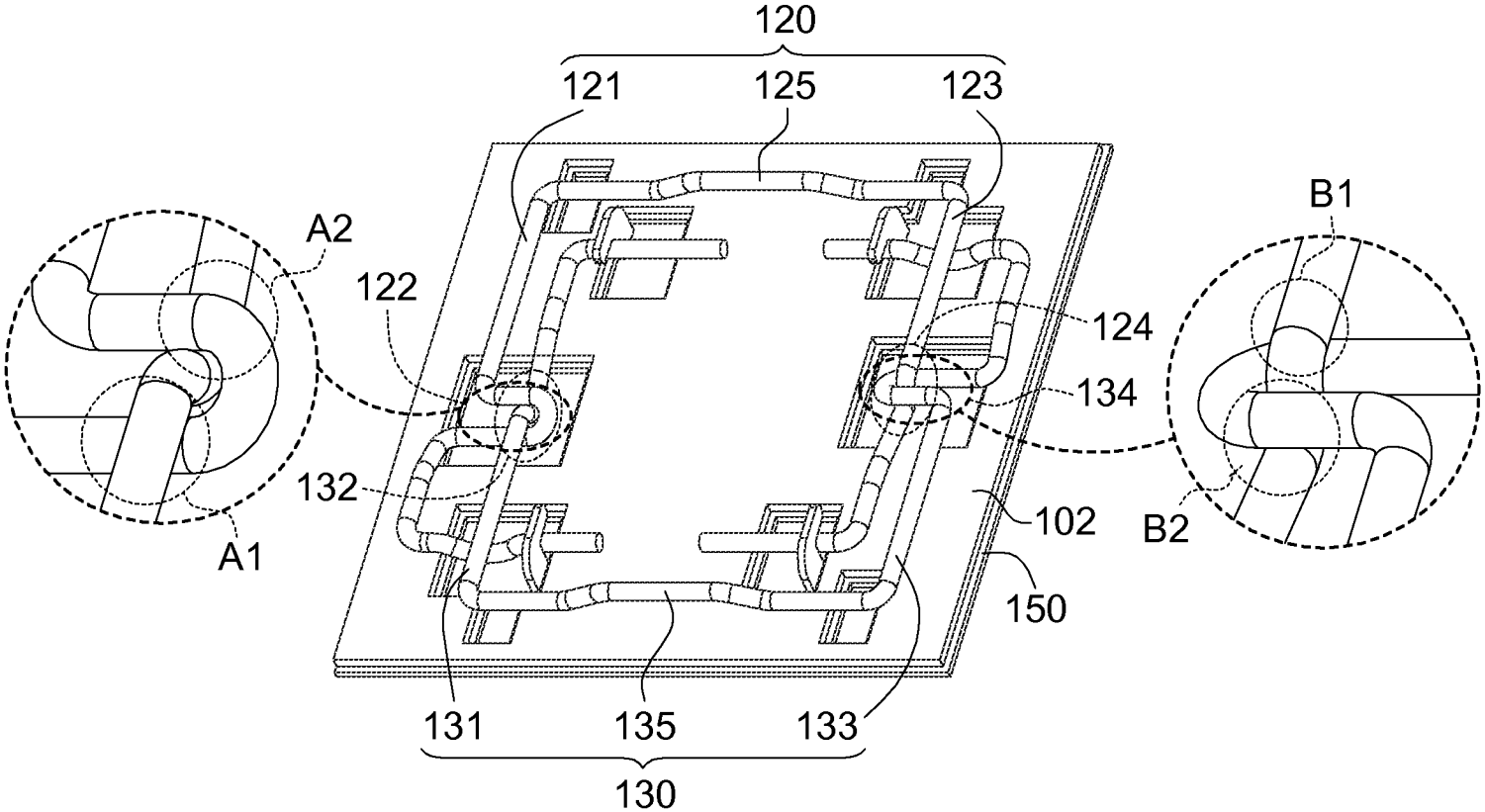
FIG. 2 is a schematic diagram of a first supporting member and a second supporting member in FIG. 1B abutting each other and fixed on the base plate.

FIG. 1A shows a diagram of a keyboard structure according to an embodiment of the present invention. FIG. 1B shows an exploded view of a button structure implemented to the keyboard structure in FIG. 1A. Referring to FIGS. 1A and 1B, a keyboard structure 10 includes a flexible printed circuit board 102 and a plurality of button structures 100. Each of the button structures 100, from top to bottom, includes a key cap 110, a first supporting member 120, a second supporting member 130, an elastomer 140 and a base plate 150. The key cap 110 is formed by two cap bodies joined with each other (or a single cap body). The elastomer 140 is disposed on the flexible printed circuit board 102, and is for touching the flexible printed circuit board 102. FIG. 2 shows a schematic diagram of the first supporting member 120 and the second supporting member 130 in FIG. 1B abutting each other and fixed on the base plate 150. The first supporting member 120 and the second supporting member 130 may be two supporting members having a same shape but arranged in opposite directions. The first supporting member 120 includes a first bending portion 122 and a second bending portion 124. The second supporting member 130 includes a third bending portion 132 and a fourth bending portion 134. The third bending portion 132 passes through the first bending portion 122 and abuts an inside of the first bending portion 122. The second bending portion 124 passes through the fourth bending portion 134 and abuts an inside of the fourth bending portion 134. For example, the first bending portion 122 and the fourth bending portion 134 are bent as a horseshoe, and openings of the first bending portion 122 and the fourth bending portion 134 are in opposite directions. In this embodiment, the openings of the first bending portion 122 and the fourth bending portion 134 both face outwards. In another embodiment, the openings of the first bending portion 122 and the fourth bending portion 134 may both face inwards and face each other. Alternatively, in another embodiment, one of the openings of the first bending portion 122 and the fourth bending portion 134 may face inwards while the other may face outwards. The direction to which the openings face is not a limitation to the present invention.

For example, the second bending portion 124 and the third bending portion 132 are bent as a slanted step. That is, one side of the second bending portion 124 and the third bending portion 132 is higher and the other side is lower, with a slanted middle part connecting the two sides, to appear as a shape of a slide. Referring to an enlarged view at the left of FIG. 2, when the third bending portion 132 abuts the first bending portion 122, the higher side of the third bending portion 132 passes above the first bending portion 122 to form an upper abutting point A1, and the lower side of the third bending portion 132 passes below the first bending portion 122 to form a lower abutting point A2. Similarly, referring to an enlarged view at the right of FIG. 2, when the second bending portion 124 abuts the fourth bending portion 134, the higher side of the second bending portion 124 passes above the fourth bending portion 134 to form an upper abutting point B1, and the lower side of the second bending portion 124 passes below the fourth bending portion 134 to form a lower abutting point B2. Therefore, when the first supporting member 120 moves downwards due to a received force, cross-connected movements of the first supporting member 120 and the second supporting member 130 are generated via the upper right abutting point B1 and the lower left abutting point A2. Similarly, when the second supporting member 130 moves downwards due to a received force, cross-connected movements of the second supporting member 130 and the first supporting member 120 are generated via the upper left abutting point A1 and the lower right abutting point B2. Hence, left and right sides of the key cap 110 are steadily supported to prevent horizontal wavering or uneven stress.

Referring to FIG. 2, the first supporting member 120 includes a first arm 121, a second arm 123 and a first connecting rod 125. The first connecting rod 125 is for supporting the key cap 110, and connects between the first arm 121 and the second arm 123. The first bending portion 122 is located at the first arm 121 to form a horseshoe first arm 121; the second bending portion 124 is located at the second arm 123 to form a slanted-step second arm 123. Thus, the first arm 121 and the second arm 123 are differently shaped. The first arm 121, the second arm 123 and the first connecting rod 125 are integrally formed by bending a metal wire. Directions of movements at ends of the first arm 121 and the second arm 123 are limited by a limiting element 155*a*, such that the ends are only capable of horizontal movements on a surface of the base plate 150.

Similarly, the second supporting member 130 includes a third arm 131, a fourth arm 133 and a second connecting rod 135. The second connecting rod 135 is for supporting the key cap 110, and connects between the third arm 131 and the fourth arm 133. The third bending portion 132 is located at the third arm 131 to form a slanted-step third arm 131. The fourth bending portion 134 is located at the fourth arm 133 to form a horseshoe fourth arm 133. Thus, the third arm 131 and the fourth arm 133 are differently shaped. The third arm 131, the fourth arm 133 and the second connecting rod 135 are integrally formed by bending a metal wire. Directions of movements at ends of the third arm 131 and the fourth arm 133 are limited by a limiting element 155*b*, such that the ends are only capable of horizontal movements on the surface of the base plate 150. After bending the metal wire, the first supporting member 120 and the second supporting member 130 may form two supporting members having a same shape but arranged in opposite directions.

In the embodiment, the first arm 121 may be located at one side of the third arm 131 (e.g., an outer side of the third arm 131), and the first arm 121 and the third arm 131 are overlapped at an abutting point. The second arm 123 is located at one side of the fourth arm 133 (e.g., an inner side of the fourth arm 133), and the second arm 123 and the fourth arm 133 are overlapped at an abutting point. In another embodiment, the first arm 121 may be located at an inner side of the third arm 131, and the second arm 123 may be located at an outer side of the fourth arm 133. In an alternative embodiment, the first arm 121 and the second arm 123 may both be located at the inner sides, or both located at the outer sides. The relative positions above are not to be construed as limiting the present invention.

Figure 3:
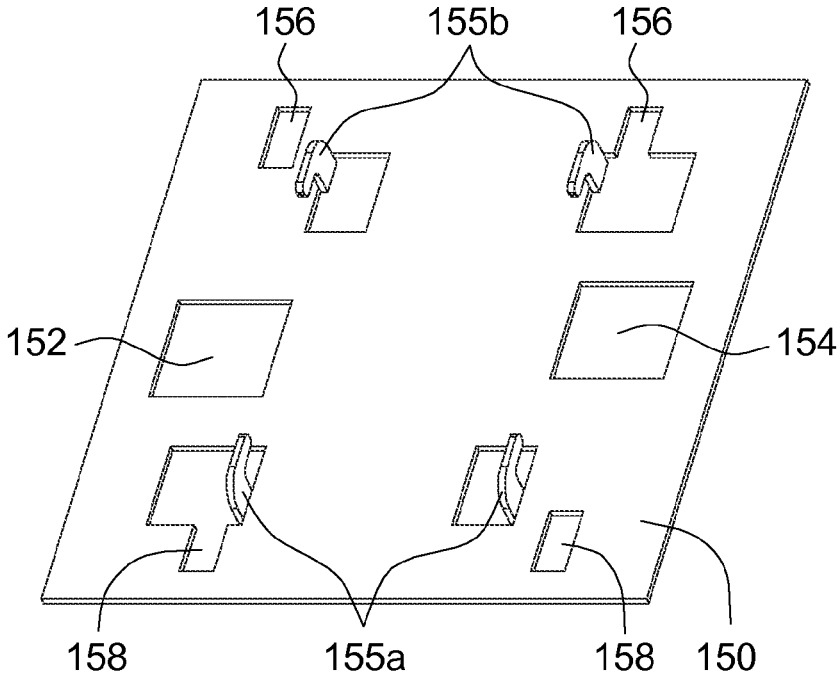
FIG. 3 is a schematic view of a front side of openings and limiting elements of the base plate in FIG. 2.
Figure 4:
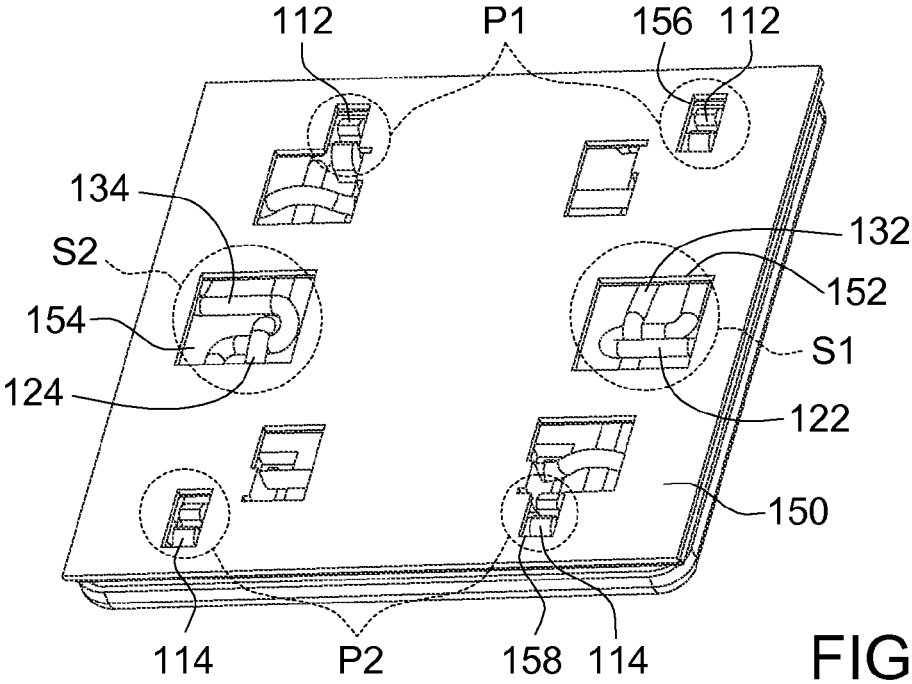
FIG. 4 is a schematic diagram of a rear side of a first supporting member and a second supporting member corresponding to openings of a base plate in FIG. 2.

FIG. 3 shows a schematic view of a front side of openings and limiting elements of the base plate 150 in FIG. 2. FIG. 4 shows a schematic diagram of a rear side of the first supporting member 120 and the second supporting member 130 corresponding to the openings of the base plate 150 in FIG. 2. In FIG. 3, the base plate 150 respectively has a first opening 152 and a second opening 154 at its left and right sides, and two third openings 156 (or at least one third opening 156 having a larger size) and two fourth openings 158 (or at least one fourth opening 158 having a larger size) at its upper and lower sides. In FIG. 4, the first opening 152 corresponds to an abutting point S1 of the first bending portion 122 and the third bending portion 132, and the second opening 154 corresponds to an abutting point S2 of the second bending portion 124 and the fourth bending portion 134. When the first supporting member 120 and the second supporting member 130 move downwards due to a received force, the first bending portion 122 and the second bending portion 124 respectively abut against the third bending portion 132 and the fourth bending portion 134 to move in a cross-connected manner, and are respectively accommodated in the first opening 152 and the second opening 154.

Figure 5:
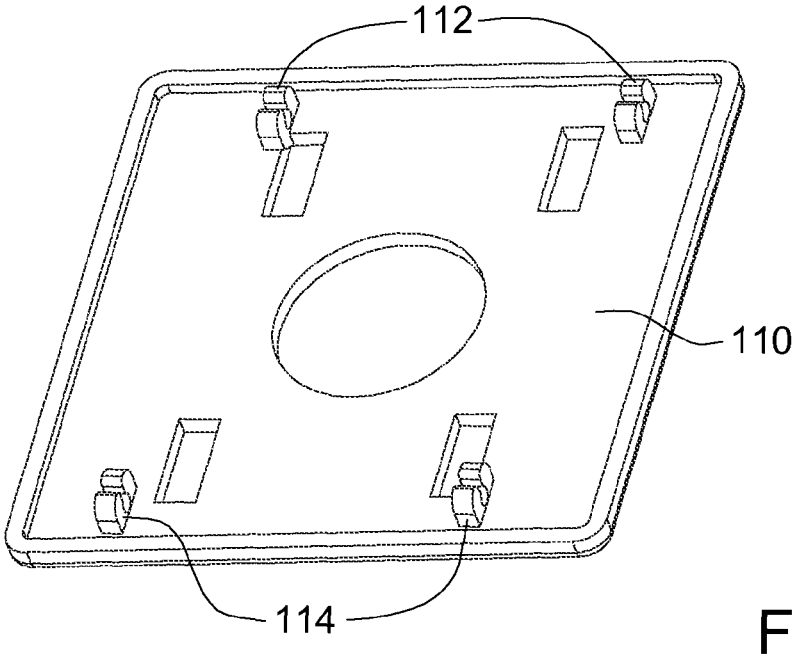
FIG. 5 is a schematic diagram of first pivoting sections and second pivoting sections at a bottom of a key cap in FIG. 1B.

FIG. 5 shows a schematic diagram of first pivoting sections 112 and second pivoting sections 114 at a bottom of the key cap 110 in FIG. 1B. Referring to FIGS. 4 and 5, the bottom of the key cap 110 is provided with two first pivoting sections 112 (or at least one first pivoting section 112 in a larger size) at its upper side and two pivoting sections 114 (or at least one second pivoting section 114) at its lower side. The first pivoting sections 112 are for connecting to the first connecting rod 125, and the second pivoting sections 114 are for connecting to the second connecting rod 135. In FIG. 4, the third openings 156 correspond to connecting points P1 of the first pivoting sections 112 and the first connecting rod 125, and the fourth openings 158 correspond to connecting points P2 of the second pivoting sections 114 and the second connecting rod 135. When the first supporting member 120 and the second supporting member 130 move downwards due to a received force, the first pivoting sections 112 and the second pivoting sections 114 are also moved downwards, and are respectively accommodated in the third openings 156 and the fourth openings 158.

Figure 6A:
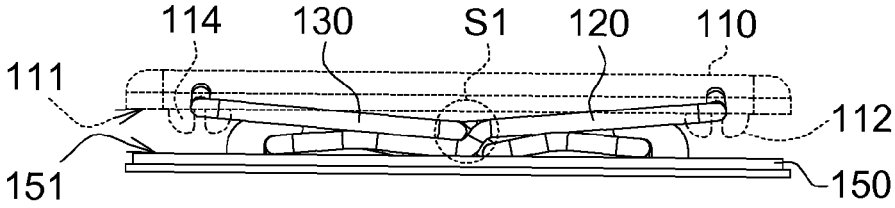
FIGS. 6A and 6B respectively show operations of a first supporting member and a second supporting member before and after a button structure receives pressure.
Figure 6B:
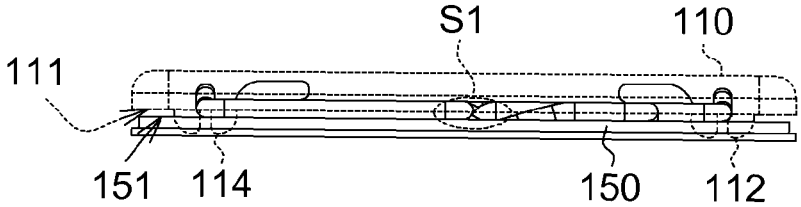

FIGS. 6A and 6B respectively show operations of the first supporting member 120 and the second supporting member 130 before and after the button structure 100 receives pressure. To better observe operations of the first supporting member 120 and the second supporting member 130, the key cap 110, the first pivoting sections 112 and the second pivoting sections 114 are represented in dotted lines. In FIG. 6A, the key cap 110 is supported by the elastomer 140 below and is thus maintained at an appropriate distance from the base plate 150. The first supporting member 120, the second supporting member 130 and the elastomer 140 are supported between the key cap 110 and the base plate 150. Further, the key cap 100 moves up and down through the operations of the first supporting member 120, the second supporting member 130 and the elastomer 140 (referring to FIG. 1B), so as to touch the flexible printed circuit board 102 (referring to FIG. 1B) to send out a press signal. In FIG. 6B, a lower edge 111 of the key cap 110 almost seamlessly reaches an upper edge 151 of the base plate 150 such that the button structure 100 is kept compact under long travel touch.

Since the first supporting member 120 and the second supporting member 130 are made of a wire that needs no additionally dedicated mold and the wires are cross-connected instead of being connecting by axle holes, an assembly process is kept simple while cost for molding is eliminated. Further, the wires, advantaged by being small in size, light in weight and high in strength, are capable of reducing overall weight and height of the keyboard structure 10 to fulfill requirements for a compact design.

While the invention has been described by way of example and in terms of the preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A button structure, comprising:

a key cap;

a first supporting member, connected to a bottom of the key cap, comprising a first bending portion and a second bending portion, wherein the first supporting member comprises a first arm, a second arm and a first connecting rod, the first connecting rod is for supporting the key cap and connects between the first arm and the second arm, and the first bending portion is located at the first arm and the second bending portion is located at the second arm, the first arm and the second arm are differently shaped;

a second supporting member, connected to the bottom of the key cap, cross-connected with the first supporting member, comprising a third bending portion and a fourth bending portion, the third bending portion passing through the first bending portion and abutting an inside of the first bending portion, the second bending portion passing through the fourth bending portion and abutting an inside of the fourth bending portion;

an elastomer, located below the key cap, for supporting the key cap; and a base plate, for supporting the first supporting member, the second supporting member and the elastomer;

wherein, the key cap moves up and down through operations of the first supporting member, the second supporting member and the elastomer.

2. The button structure according to claim 1, wherein the first bending portion and the fourth bending portion are bent as a horseshoe.

3. The button structure according to claim 1, wherein the second bending portion and the third bending portion are bent as a slanted step.

4. The button structure according to claim 1, wherein the first arm, the second arm and the first connecting rod are integrally formed by bending a metal wire.

5. The button structure according to claim 1, wherein the second supporting member comprises a third arm, a fourth arm and a second connecting rod, the second connecting rod is for supporting the key cap and connects between the third arm and the fourth arm, the third bending portion is located at the third arm and the fourth bending portion is located at the fourth arm, such that the first arm and the second arm respectively abut and cross-connects with the third arm and the fourth arm.

6. The button structure according to claim 5, wherein the third arm and the fourth arm are differently shaped.

7. The button structure according to claim 5, wherein the third arm and the fourth arm are integrally formed by bending a metal wire.

8. The button structure according to claim 5, wherein the first arm is located at one side of the third arm, and the first arm and the third arm overlap each other at an abutting point; the second arm is located at one side of the fourth arm, and the second arm and the fourth arm overlap each other at an abutting point.

9. The button structure according to claim 5, wherein the base plate comprises a first opening and a second opening, the first opening corresponds to an abutting point of the first bending portion and the third bending portion, and the second opening corresponds to an abutting point of the second bending portion and the fourth bending portion.

10. The button structure according to claim 5, wherein the key cap comprises at least one first pivoting section and at least one second pivoting section, the at least one first pivoting section connects to the first connecting rod, and the at least one second pivoting section connects to the second connecting rod.

11. The button structure according to claim 10, wherein the base plate comprises at least one third opening and at least one fourth opening, the at least one third opening corresponds to a connecting point of the at least one first pivoting section and the first connecting rod, and the at least one fourth opening corresponds to a connecting point of the at least one second pivoting section and the second connecting rod.

12. A keyboard structure, comprising:

a flexible printed circuit board; and a plurality of button structures, for touching the flexible printed circuit board, each of the button structures comprising:

a key cap;

a first supporting member, connected to a bottom of the key cap, comprising a first bending portion and a second bending portion, wherein the first supporting member comprises a first arm, a second arm and a first connecting rod, the first connecting rod is for supporting the key cap and connects between the first arm and the second arm, and the first bending portion is located at the first arm and the second bending portion is located at the second arm, the first arm and the second arm are differently shaped;

a second supporting member, connected to the bottom of the key cap, cross-connected with the first supporting member, comprising a third bending portion and a fourth bending portion, the third bending portion passing through the first bending portion and abutting an inside of the first bending portion, the second bending portion passing through the fourth bending portion and abutting an inside of the fourth bending portion;

an elastomer, located below the key cap, for supporting the key cap; and a base plate, for supporting the first supporting member, the second supporting member and the elastomer;

wherein, the key cap moves up and down through operations of the first supporting member, the second supporting member and the elastomer.

13. The keyboard structure according to claim 12, wherein the first bending portion and the fourth bending portion are bent as a horseshoe, and the second bending portion and the third bending portion are bent as a slanted step.

14. A button structure, comprising:

a key cap;

a first supporting member, connected to a bottom of the key cap, comprising a first bending portion on a first arm and a second bending portion on a second arm;

a second supporting member, connected to the bottom of the key cap, cross-connected with the first supporting member, comprising a third bending portion and a fourth bending portion, the third bending portion passing through the first bending portion and abutting an inside of the first bending portion, the second bending portion passing through the fourth bending portion and abutting an inside of the fourth bending portion, wherein the second supporting member comprises a third arm and a fourth arm, the third bending portion is located at the third arm and the fourth bending portion is located at the fourth am, such that the first arm and the second arm respectively abut and cross-connects with the third arm and the fourth arm, the third arm and the fourth arm are differently shaped;

an elastomer, located below the key cap, for supporting the key cap; and a base plate, for supporting the first supporting member, the second supporting member and the elastomer.

15. The button structure according to claim 14, wherein the base plate comprises a first opening and a second opening, the first opening corresponds to an abutting point of the first bending portion and the third bending portion, and the second opening corresponds to an abutting point of the second bending portion and the fourth bending portion.

16. The button structure according to claim 14, wherein the key cap comprises at least one pivoting section connecting to the connecting rod; and the base plate comprises at least one opening corresponding to an connecting point of the at least one pivoting section and the connecting rod.

* * * * *